US005927702A

United States Patent [19]

Ishii et al.

[11] Patent Number: 5,927,702

[45] Date of Patent: Jul. 27, 1999

[54] SHEET FEEDER AND IMAGE FORMING APPARATUS USING THE SAME

[75] Inventors: Hiroyuki Ishii, Abiko; Yuzuru Tsurumi, Ushiku; Masahide Tanoue, Kashiwa; Hidehiko Kajiya, Abiko; Akira Yuza; Ryuichi Kojima, both of Toride, all of Japan

[73] Assignee: Canon Kabushiki Kaisha, Tokyo, Japan

[21] Appl. No.: 08/882,097

[22] Filed: Jul. 8, 1997

[30] Foreign Application Priority Data

| | | | |
|---|---|---|---|
| Jul. 11, 1996 | [JP] | Japan | 8-182040 |
| Apr. 2, 1997 | [JP] | Japan | 9-083805 |

[51] Int. Cl.[6] ..... B65H 3/44; B65H 1/00

[52] U.S. Cl. ..... 271/9.09; 271/240; 271/171; 271/9.11; 271/9.13; 400/642; 400/633

[58] Field of Search ..... 271/240, 171, 271/9.09, 9.13, 9.11; 400/642, 633, 630, 629, 625, 624, 605, 603.1, 603, 600.3

[56] References Cited

U.S. PATENT DOCUMENTS

| | | | |
|---|---|---|---|
| 1,503,069 | 7/1924 | Smith | 400/633 |
| 1,698,426 | 1/1929 | Blaisdell | 400/600.3 |
| 2,195,464 | 3/1940 | Loewenstein | 400/605 |
| 2,731,125 | 1/1956 | Haselmeier | 400/603 |
| 4,806,035 | 2/1989 | Maeda | 400/642 |
| 4,874,160 | 10/1989 | Yamamoto | 271/171 |
| 4,907,792 | 3/1990 | Washiashi et al. | 271/171 |
| 5,091,754 | 2/1992 | Abe et al. | 271/240 |
| 5,253,854 | 10/1993 | Tanoue et al. . | |
| 5,261,651 | 11/1993 | Ishida | 271/171 |
| 5,332,208 | 7/1994 | Tsuji et al. | 271/171 |
| 5,358,230 | 10/1994 | Ikemori et al. . | |
| 5,533,721 | 7/1996 | Takashimizu | 271/171 |

FOREIGN PATENT DOCUMENTS

| | | | |
|---|---|---|---|
| 357199739 | 12/1982 | Japan | 271/9.09 |
| 360061428 | 4/1985 | Japan | 271/171 |
| 0017740 | 1/1989 | Japan | 271/171 |
| 405070000 | 3/1993 | Japan | 271/240 |
| 405319583 | 12/1993 | Japan | 271/171 |

*Primary Examiner*—H. Grant Skaggs
*Assistant Examiner*—Wonki Park
*Attorney, Agent, or Firm*—Fitzpatrick, Cella, Harper & Scinto

[57] ABSTRACT

A sheet to be fed by a sheet feed roller is loaded on a sheet feed tray, and a side regulating member is disposed so as to be movable in accordance with the sheet size in order to regulate the position of the loaded sheet in the direction of the sheet width. The side regulating member extends downstream from the sheet feed roller in the sheet feeding direction in order to regulate the position of the sheet in the direction of the sheet width, thereby preventing oblique movement of the sheet.

15 Claims, 11 Drawing Sheets

SHEET FEEDER AND IMAGE FORMING APPARATUS USING THE SAME

BACKGROUND OF THE INVENTION

1. Field of the Invention

The present invention relates to a sheet feeder used, for example, in an image forming apparatus, such as a laser beam printer or an electronic copying machine, and an image forming apparatus which forms an image on a sheet fed from the sheet feeder.

1. Description of the Related Art

A conventional sheet feeder is constructed as shown in FIG. 11, which is a sectional view of a laser printing type image forming apparatus 1. A plurality of sheets P, loaded on a sheet feed tray 2, are successively fed one sheet at a time by a sheet feed roller 3. Reference numeral 4 denotes a pair of conveyor rollers that convey a sheet P fed by the roller 3 toward a transfer roller 5. Reference numeral 6 denotes a process cartridge which integrally incorporates a photosensitive member 7, such as an electronic photosensitive drum, which is an image carrying member, and image forming means, such as a developing means. Reference numeral 8 denotes a laser scanning optical system for forming an electrostatic latent image on the photosensitive member 7. A toner image transferred onto the sheet P by the transfer roller 5 is fixed onto the sheet P by heating with a fixing device 9, after which the sheet P with the fixed image is discharged onto a discharge tray 11 by means of a pair of discharge rollers 10.

Various proposals have been made to prevent displacement of the printed image from occurring when the sheet P on the sheet feed tray 2 is obliquely fed as it moves to the transfer roller 5. It may be prevented by:

(1) Providing a side regulating member 12 for sandwiching both sides of the sheet on the sheet feed tray 2, or (2) Stopping the rotation of the pair of conveyor rollers 4 until the leading end of the sheet P reaches the nip portion of the pair of conveyor rollers 4, and forming a loop between the sheet feed roller 3 and the pair of conveyor rollers 4 in order to properly register the sheet, thus eliminating oblique movement.

However, proposal (1) has the problem that the sheets on the sheet feed tray 2 tend to tilt, since the side regulating member 12 is provided only on the sheet feed tray 2. In addition, the side regulating member 12 cannot effectively prevent oblique movement after the trailing end of the sheet has left the side regulating member 12. Proposal (2) has the problem that a clutch mechanism, formed by an electromagnetic clutch or the like, must be provided at the conveyor roller driving section in order to properly register the sheets by the pair of conveyor rollers 4, thereby increasing manufacturing costs.

SUMMARY OF THE INVENTION

In view of the above-described problems, an object of the present invention is to provide a sheet feeder with a simple structure, which reliably prevents oblique movement of a sheet.

To this end, according to the present invention, there is provided a sheet feeder, comprising: a sheet support which supports a plurality of sheets; sheet feeding means for feeding sheets from the sheet support; and side regulating means for regulating both side edges of sheets supported by the sheet support in the direction of the width of the sheets, the side regulating means extending downstream from the sheet feeding means in a direction of sheet feeding so as to regulate both side edges of a sheet being fed.

DESCRIPTION OF THE PREFERRED EMBODIMENT

Figure 1:
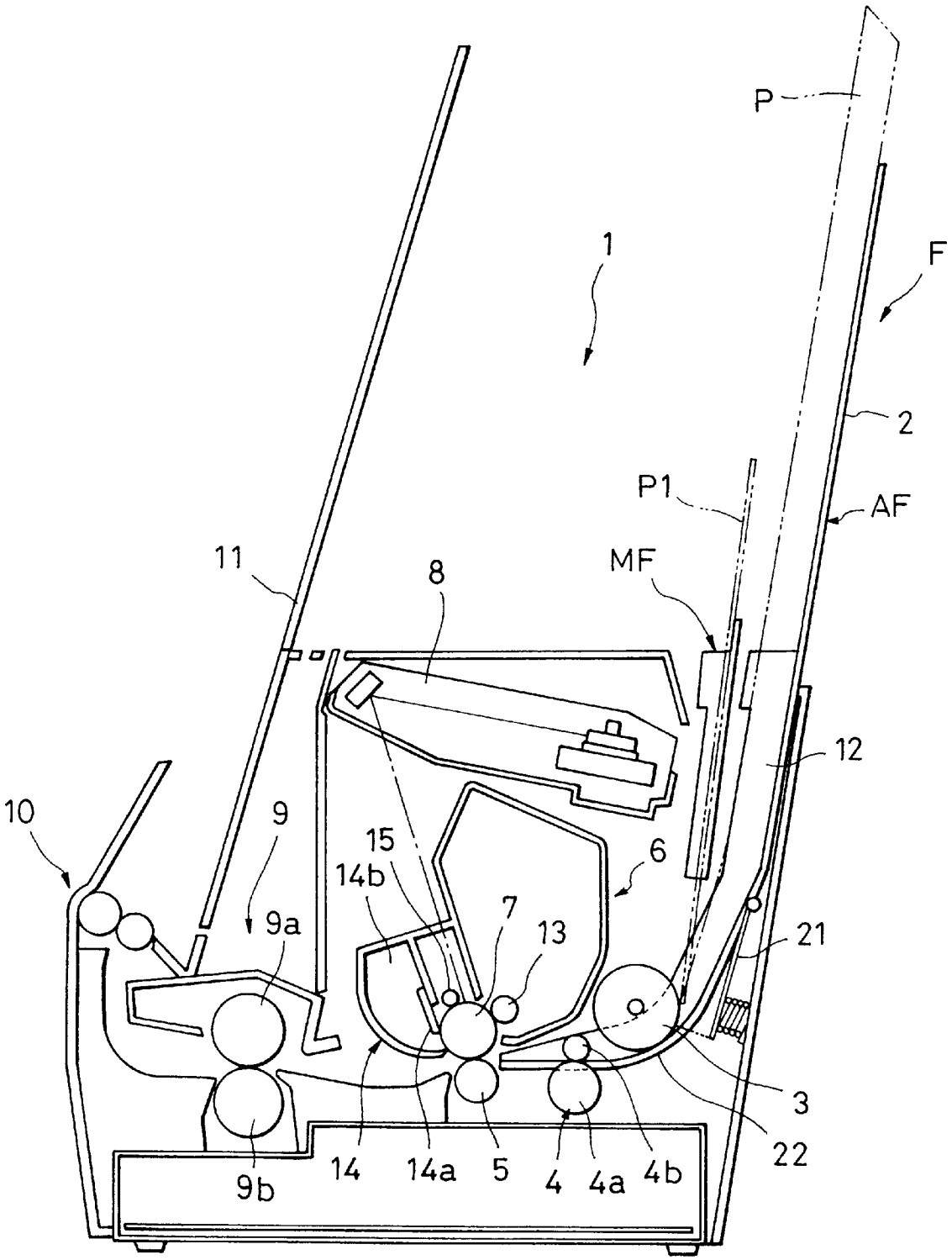
FIG. 1 is a vertical section of an image forming apparatus with a sheet feeder of the present invention.

FIG. 1 is a view showing the structure of an image forming apparatus. In the image forming apparatus 1, in accordance with image information, an optical system irradiates a laser beam carrying an optical image onto a photosensitive drum 7, being an image carrying member, to form a latent image onto the drum 7. The latent image is made visible by a developer (hereinafter referred to as "toner") to form a toner image on the drum 7. In synchronism with the formation of the toner image, a sheet P is supplied by a sheet feeder. Then, at an image forming means constructed as a process cartridge 6, the toner image, formed on the photosensitive drum 7, is transferred onto the sheet P as a result of applying of a voltage to a transfer roller 5 serving as transfer means. The sheet P is thereafter conveyed between a fixing rotary member 9*a* and a driving roller 9*b*, both of which form the fixing means 9, causing the transferred toner image to be fixed onto the transfer sheet P. The fixing rotary member 9*a* has a heater in its interior, while the driving roller 9*b* presses the sheet P against the fixing rotary member 9*a* for conveying the sheet P. Thereafter, the sheet P is reversed by a pair of discharge rollers 10 which discharge the sheet P onto a discharge tray 11.

In the construction of the process cartridge 6 forming the image forming means, the photosensitive drum 7 having a photosensitive layer rotates, with its surface charged uniformly by application of a voltage to a charging roller 15. The photosensitive drum 7 is exposed to the laser beam carrying an optical image from the optical system 8 through an exposure portion, thereby forming thereon a latent image which is developed by a developing means 13. Then, a voltage with a polarity opposite to that of the toner image is applied to the transfer roller 5 in order to transfer the toner image onto the sheet P. The toner remaining on the photosensitive drum 7 is scraped off by a cleaning blade 14*a* and collected in a waste toner reservoir 14*b*, thereby effecting removal of the remaining toner from the photosensitive drum 7.

The sheet feeder F used for supplying sheets to the image forming means is a so-called multi-sheet feed type which supports a plurality of sheets which are greatly tilted with respect to the horizontal direction. This type of sheet feeder F includes a multi-sheet feed section AF, serving as an automatic sheet feed section, for successively supplying the loaded sheets P, and a manual sheet feed section MF for supplying sheets P1 one sheet at a time.

The multi-sheet feed section AF includes a multi-sheet feed tray 2 which holds the sheets P, a sheet feed roller 3 which serves as a sheet feeding means for supplying the sheets P held by the multi-sheet feed tray 2, a pressure plate 21 which serves as a sheet supporting means for pressing the sheet P against the sheet feed roller 3, a separation pad 22 for separating the sheets supplied by the sheet feed roller 3 one sheet at a time, and a pair of conveyor rollers 4 for conveying the separated sheets to the image forming means. The pair of conveyor rollers 4 comprise a driven roller 4*b* and a conveyor driving roller 4*a* which receives drive power from an apparatus body driving section (not shown).

At least one sheet feed roller 3 and at least one pair of conveyor rollers 4 are provided in order to convey the sheet from the sheet feed device F to the image forming means. A larger number of pairs of conveyor rollers 4 may be used, as required. The sheet feed roller 3 and the pair of conveyor rollers 4 are disposed such that the center of each roller in the axial direction coincides with the center of the sheet P in the direction of the width of the sheet P (that is, in the direction of extension of the sheet surface perpendicular to the direction of sheet conveyance). (See FIG. 2.)

A description will now be given of the multi-sheet feed section AF, with reference to FIGS. 2 and 3.

The multi-sheet feed tray 2 is secured to the image forming apparatus body. A left multi-sheet side regulating member 16L and a right multi-sheet side regulating member 16R, together serving as side regulating means, are provided on the multi-sheet feed tray 2 in order to regulate the positions of both side edges of the sheets P loaded on the tray 2. The left and right multi-sheet side regulating members 16L and 16R include supporting sections 16La and 16Ra, respectively, for supporting the bottom surface of the sheet P at both side edges thereof, and side walls 16Lb and 16Rb, respectively, for regulating the side edges of the sheet. The supporting sections 16L*a* and 16R*a*, and the side walls 16Lb and 16Rb extend downstream from the sheet feed roller 3 and the pair of conveyor rollers 4 in the sheet conveying direction up to a location just preceding the transfer roller 5.

The multi-sheet side regulating members 16L and 16R are supported by the multi-sheet feed tray 2 so as to be slidable in the direction of the width of the sheet. The structure thereof is described below.

The multi-sheet feed tray 2 has a pair of slots 2*a* and 2*b* extending in the direction of the width of the sheet P. A pin 2*c*, disposed between the slots 2*a* and 2*b*, protrudes out from the back side of the multi-sheet feed tray 2.

Pins 16Lc are integrally formed with the left multi-sheet side regulating member 16L that is supported by the tray 2 so as to be horizontally slidable by fitting the pins 16Lc into the slot 2*a*. Similarly, pins 16Rc are integrally formed with the right multi-sheet side regulating member 16R that is supported by the tray 2 so as to be horizontally slidable by fitting the pins 16Rc into the slot 2*b*. The left and right multi-sheet side regulating members 16L and 16R are symmetrically formed.

A left multi-rack member 18 is secured at the back side of the multi-sheet feed tray 2 to the pins 16Lc of the left multi-sheet side regulating member 16L. The left multi-rack member 18 includes holes 18*a* for fitting therein the pins 16Lc to thereby secure the left multi-rack member 18 and the left multi-sheet side regulating member 16L together. Similarly, the right multi-rack member 19 includes holes 19*a* for fitting therein the pins 16Rc to thereby secure the right multi-rack member 19 and the right multi-sheet side regulating member 16R together.

Consequently, the left multi-rack member 18 is supported by the tray 2 so as to be horizontally slidable along with the left multi-sheet side regulating member 16L, whereas the right multi-rack member 19 is supported by the tray 2 so as to be horizontally slidable along with the right multi-sheet side regulating member 16R.

A synchronous gear 20 is rotatably supported around the pin 2*c* at the back side of the multi-sheet feed tray 2. A rack portion 18*b* of the left multi-rack member 18 and a rack portion 19*b* of the right multi-rack member 19 engage the synchronous gear 20 from above and below, respectively. Therefore, moving either one of the left multi-sheet side regulating member 16L and the right multi-sheet side regulating member 16R automatically moves the other one of the left multi-sheet side regulating member 16L and the right multi-sheet side regulating member 16R, thus allowing the members 16R and 16L to move closer to and away from each other. Therefore, the center of the sheet P in the direction of the width thereof can always be aligned with the center of the sheet conveyance path in the direction of the width by moving the multi-sheet side regulating members 16L and 16R in accordance with the size of the sheets P and regulating the side edges of the sheets P.

In the present embodiment, the left and right multi-sheet side regulating members 16L and 16R move in such a way that when one member moves the other member also moves correspondingly, since the center of the conveyance path in the direction of the width of the sheet is used as the reference for sheet conveyance in the image forming apparatus, but when one side of the conveyance path is used as the reference for sheet conveyance, only one of the left and right multi-sheet side regulating members 16L and 16R is made movable.

Figure 2:
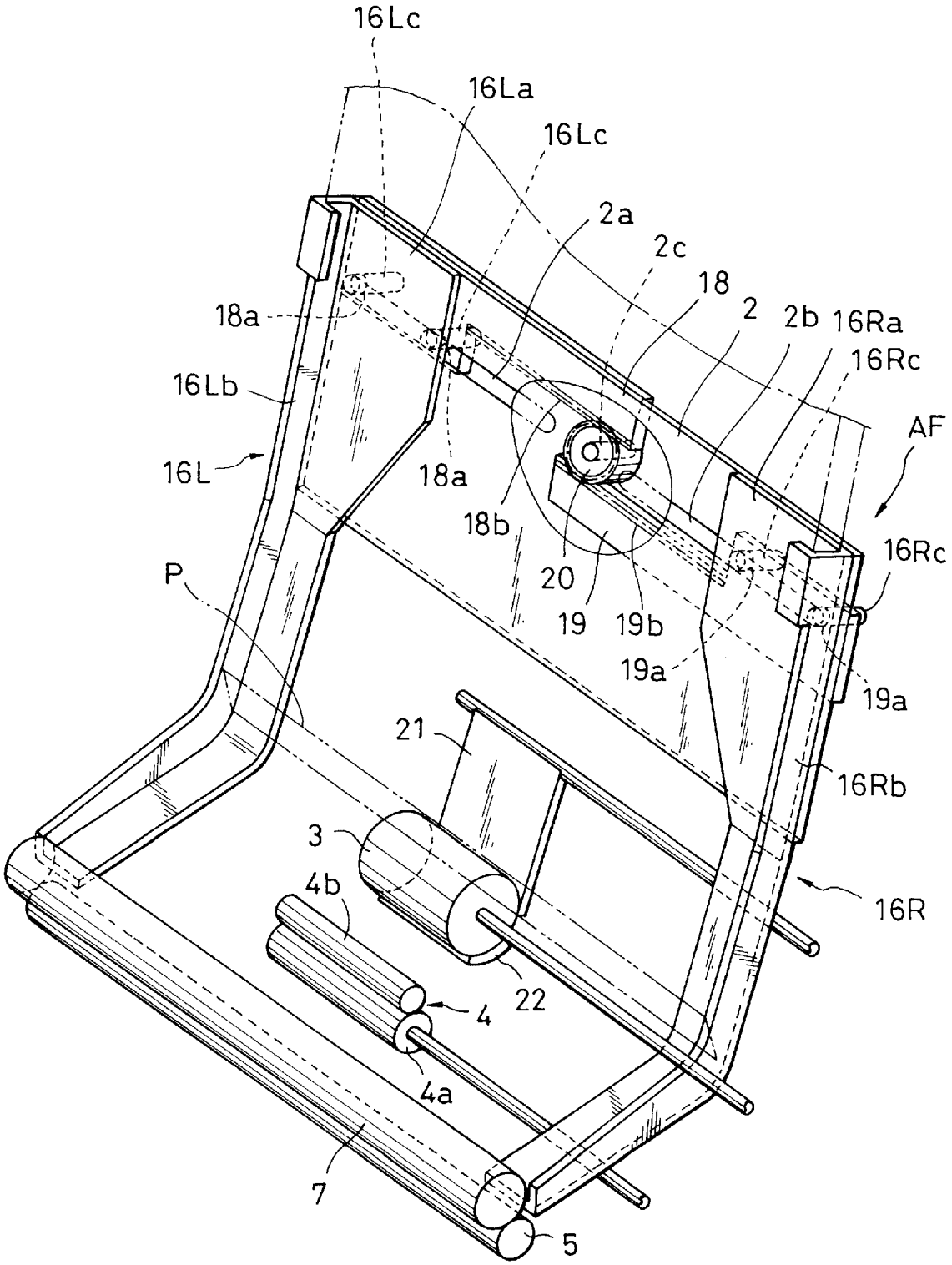
FIG. 2 is a perspective view of the automatic sheet feed section of the sheet feeder of FIG. 1.
Figure 3:
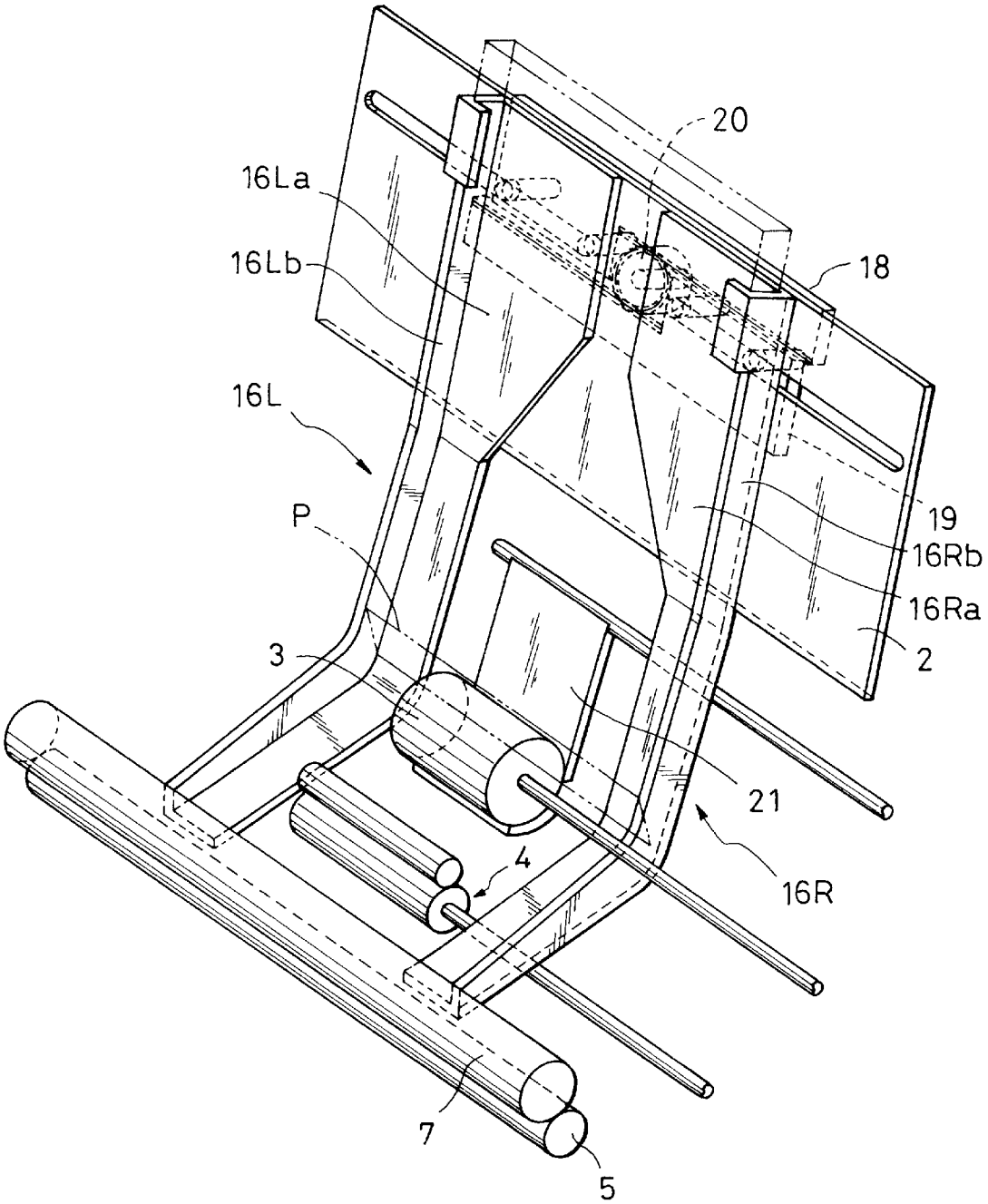
FIG. 3 is a perspective view of the sheet feeder of FIG. 2 showing a state in which a small-size sheet is loaded on the automatic sheet feed section.

In the left and right multi-sheet side regulating members 16L and 16R of the sheet feeder in FIG. 2, the pins 16L*c* and 16Rc, which serve as guides when the members 16L and 16R are sliding, are disposed at the upstream side in the sheet feeding direction. Therefore, the accuracy with which the image is formed in the proper location may be slightly reduced when the separation distance between the side regulating positions becomes larger or smaller in the vicinity of the downstream side transfer roller 5 due to play caused by imprecision of parts. This problem can be overcome by a construction shown in FIG. 4.

In this construction, the left and right multi-sheet side regulating members 16L and 16R are provided with second multi-rack members 23 and 24, respectively. As with the automatic sheet feed section shown in FIG. 2, the second multi-rack members 23 and 24 are connected to the left and right multi-sheet side regulating members 16L and 16R by fitting pins 16Ld and pins 16Rd into slots 2*d* and 2*e*, respectively, whereby the second multi-rack members 23 and 24 are slidably supported with respect to the sheet feed tray 2. A synchronous gear 25 is rotatably supported by the sheet feed tray 2 by a pin 2*f*. An idle gear 26 is supported between the synchronous gear 20 and the synchronous gear 25 by the pin 2*g*, and engages the synchronous gears 20 and 25. The synchronous gears 20 and 25 have exactly the same module and have the same number of teeth. The multi-rack members 18, 19, 23, and 24 also have the same module.

When this construction is adopted, the left and right multi-sheet side regulating members 16L and 16R can slide, while they are kept parallel to each other, thus considerably increasing the degree of parallelism therebetween and thus increasing the accuracy with which an image is formed on a proper location of the sheet.

Figure 4:
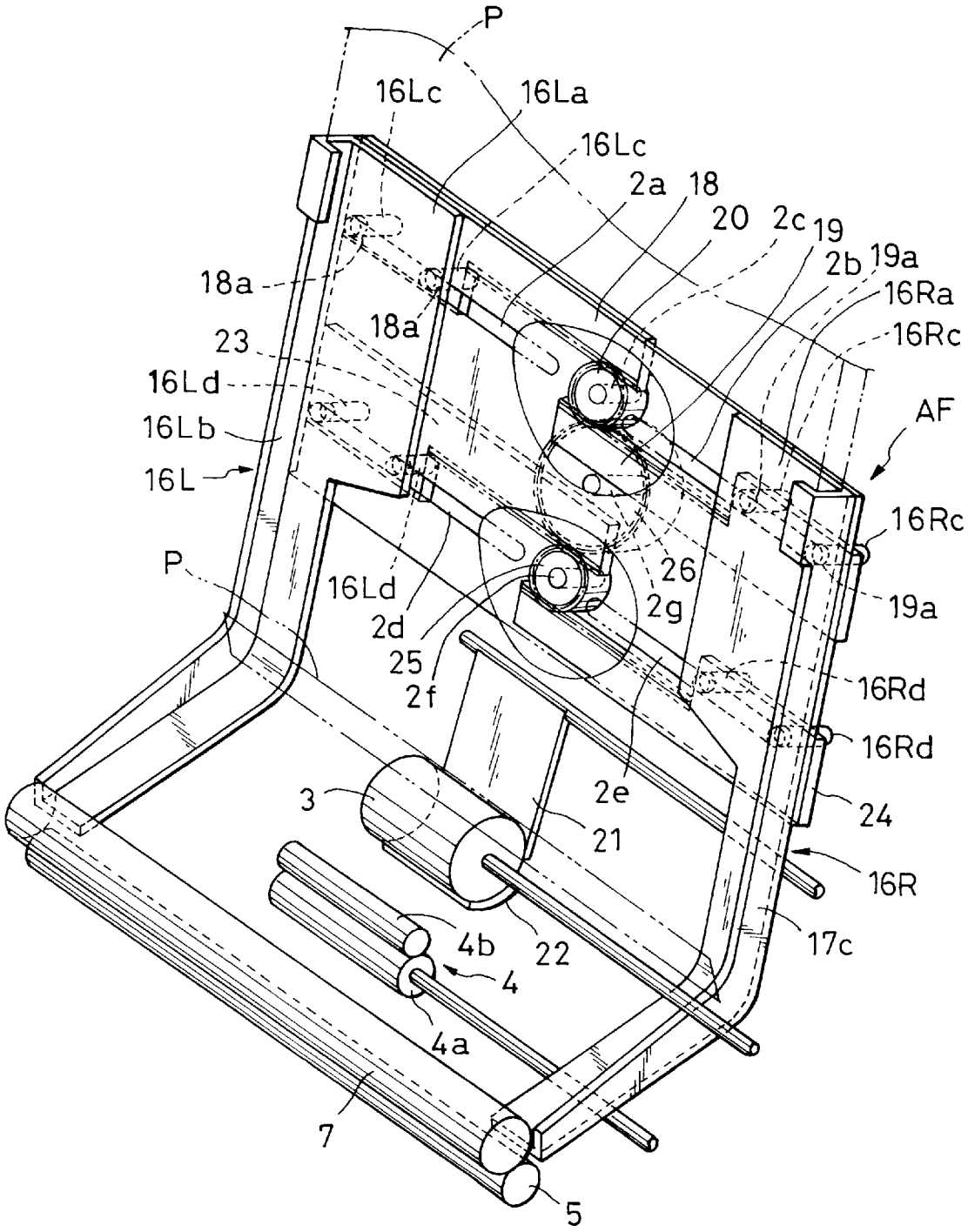
FIG. 4 is a perspective view of the automatic sheet feed section of FIG. 2 illustrating two means which allow movement of the side regulating members in such a manner that when one side regulating member moves, the other member also moves correspondingly.
Figure 5:
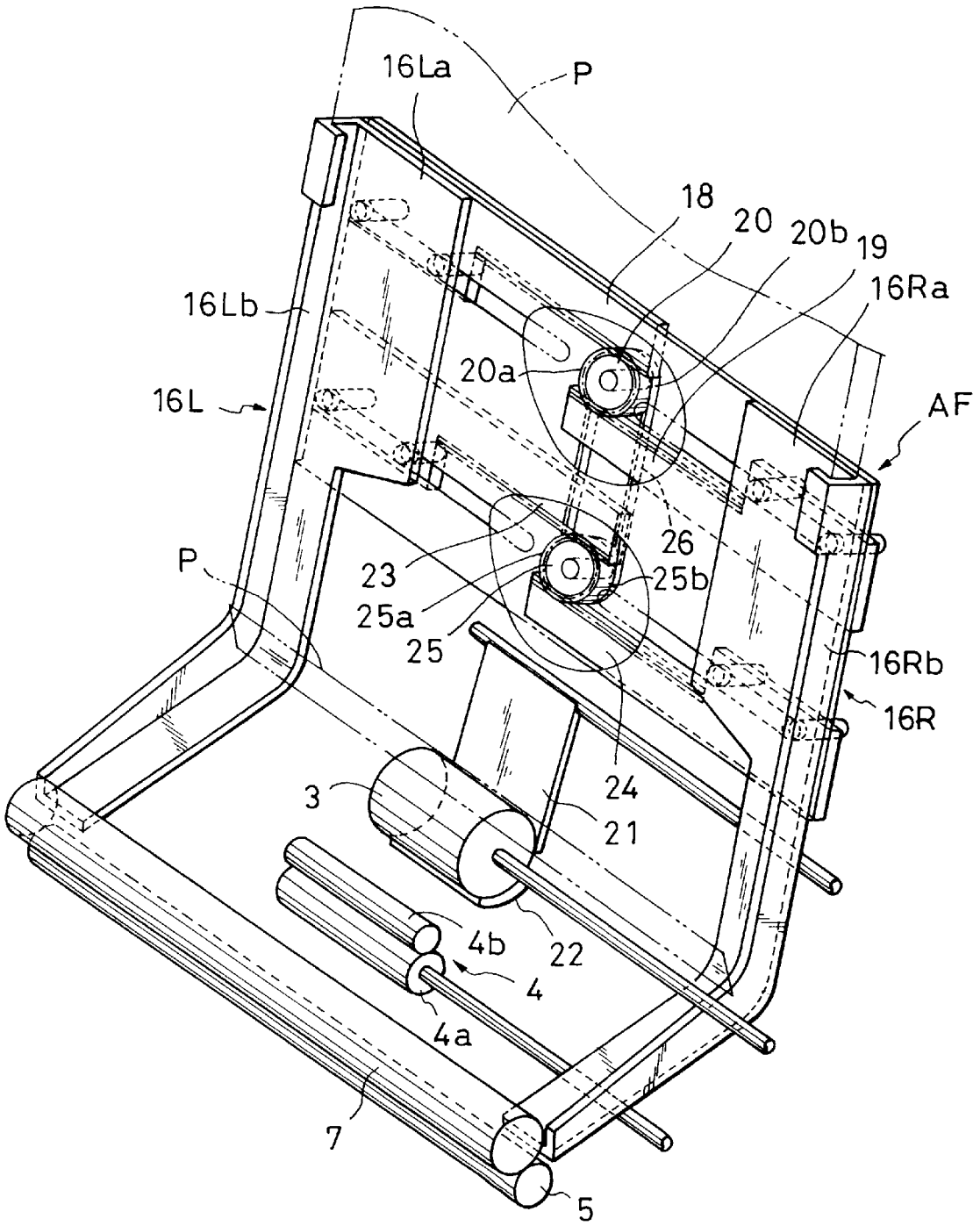
FIG. 5 is a perspective view of the automatic sheet feed section of FIG. 2 illustrating means for connecting the two means which allow movement of the side regulating members in FIG. 4.

Although in the automatic sheet feed section of FIG. 4 the gear 26 is used to allow movement of the synchronous gears 20 and 25 in such manner that when one gear moves the other gear also moves correspondingly, pulleys 20*b* and 25*b* may be formed coaxially with the gear sections 20*a* and 25*a* of the synchronous gears 20 and 25, respectively, with a timing belt 26 passed over the gears 20 and 25, as shown in FIG. 5. The pulleys 20*b* and 25*b* have the same number of teeth to engage the teeth of the timing belt 26, and the left and right multi-sheet side regulating members 16L and 16R are capable of sliding parallel to each other.

Figure 6:
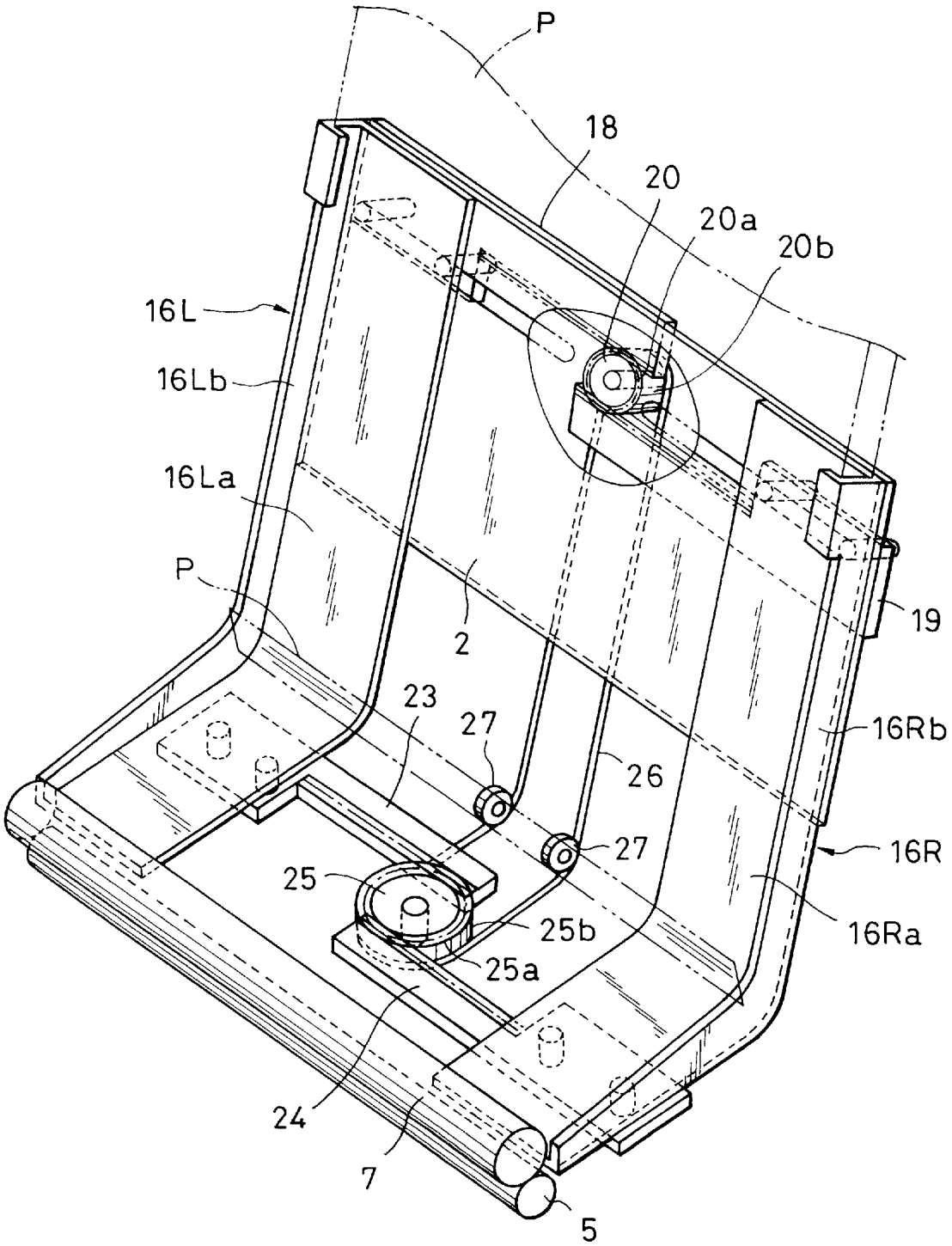
FIG. 6 is a perspective view of another example of means for connecting the two means which allow movement of the side regulating members in FIG. 4.

A more effective construction using a timing belt is described with reference to FIG. 6. In FIG. 6, the sheet feed roller 3 and the pair of conveyor rollers 4 are not shown.

The second multi-rack members 23 and 24, disposed at the downstream side in the sheet conveying direction, are provided in the vicinity of the transfer roller 5. The belt, passed around the pulleys 20*b* and 25*b*, is a round belt 26 circular in cross section. Idler pulleys 27 are provided where the conveyance path is bent in order to guide the round belt 26. This construction permits a larger separation between the upstream multi-rack members 18 and 19 and the downstream multi-rack members 23 and 24, thus ensuring a high degree of parallelism between the left and right multi-sheet side regulating members 16L and 16R.

Figure 7:
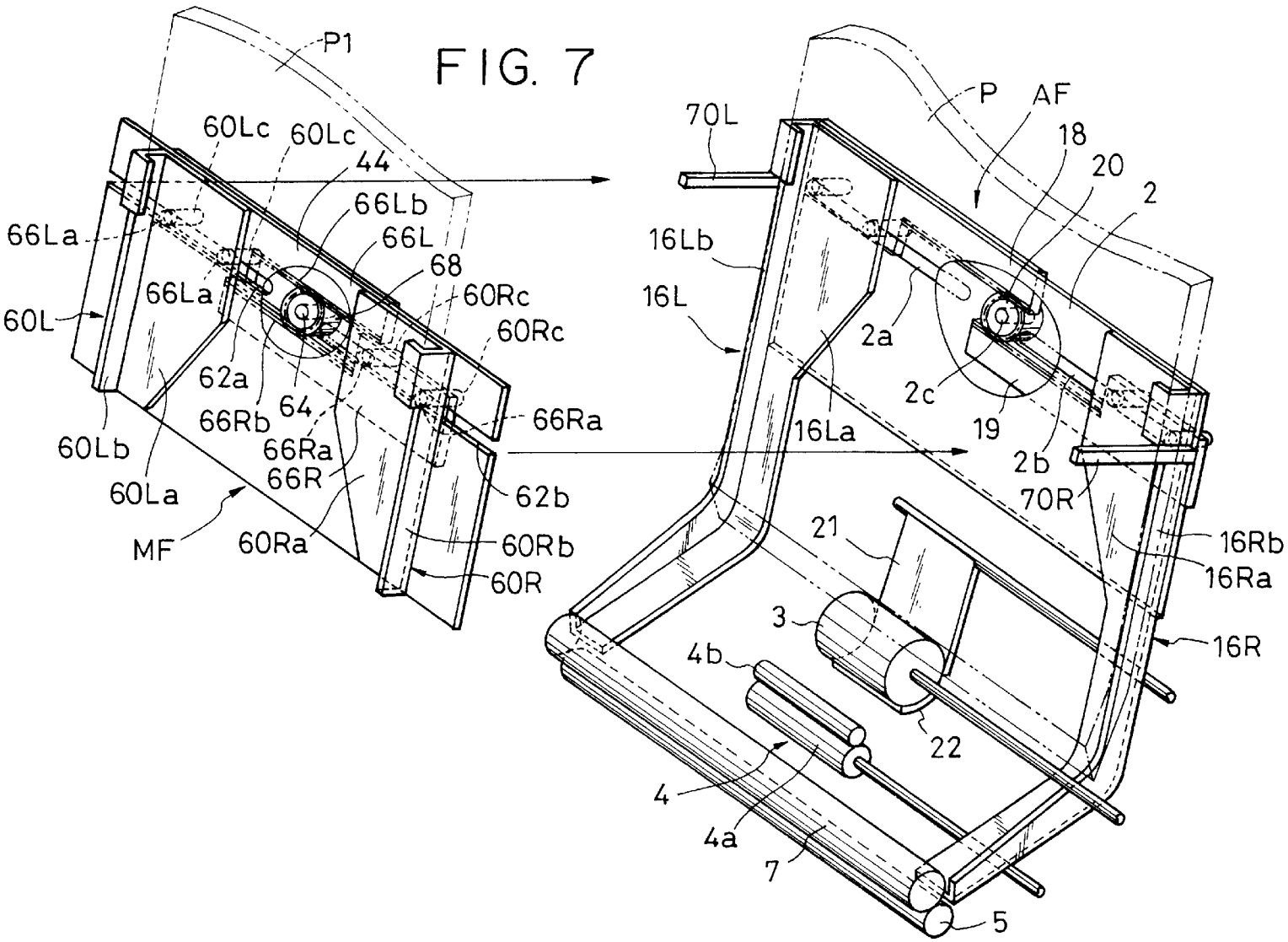
FIG. 7 is an exploded view of the automatic sheet feed section and the manual feed section.
Figure 8:
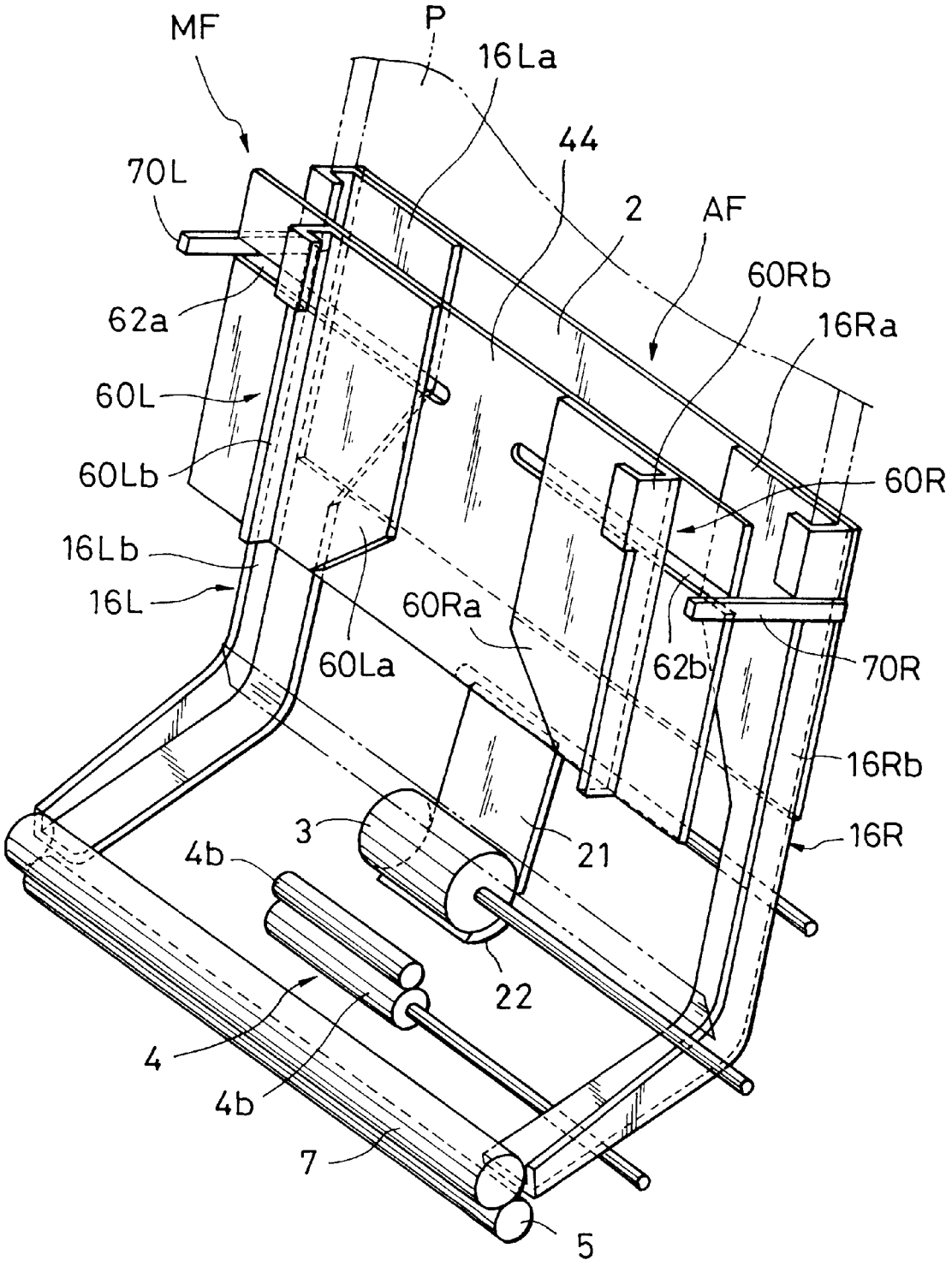
FIG. 8 is a perspective view showing the automatic sheet feed section and the manual sheet feed section in an assembled state.

With reference to FIGS. 7 and 8, a description will now be given of a manual sheet feed section MF used when sheets of a different size or made of a different material are to be fed, with the sheets P supported by the multi-sheet feed tray 2.

A manual sheet feed tray 44 of the manual sheet feed section MF is fixed to either the image forming apparatus body or the multi-sheet feed tray 2. The manual sheet feed tray 44 is provided with left and right manual feed side regulating members 60L and 60R in order to regulate and position both edges of a manual feed sheet P1. The left and right manual feed side regulating members 60L and 60R have supporting portions 60La and 60Ra, respectively, and side walls 60Lb and 60Rb, respectively. The supporting portions 60La and 60Ra support the bottom side of the manual feed sheet P1 at the side edge portions of the sheet P1, while the side walls 60Lb and 60Rb regulate the side edges of the manual feed sheet P1. The supporting portions 60La and 60R*a* and the side walls 60Lb and 60Rb only extend up to the upstream side of the sheet feed roller 3.

The manual sheet feed tray 44 has a pair of slot-shaped cutouts 62*a* and 62*b* disposed on opposite sides of the manual feed tray 44 along the same line, and that extend through the side edges of the manual feed tray 44 in the direction of the width of the manual feed sheet P1. A pin 64, disposed between the cutouts 62*a* and 62*b*, protrudes from the back side of the manual sheet feed tray 44.

Pins 60Lc are integrally formed with the left manual feed side regulating member 60L that is supported by the tray 44 so as to be horizontally slidable by fitting the pins 60Lc into the cutout 62*a*. Similarly, pins 60Rc are formed integrally with the right manual feed side regulating member 60R that is supported by the tray 44 so as to be slidable horizontally by fitting the pins 60Rc into the cutout 62*b*. The left and right manual feed side regulating members 60L and 60R are formed symmetrically.

A left manual feed rack member 66L is secured at the back side of the manual sheet feed tray 44 to the pins 60Lc of the left manual feed side regulating member 60L. The left feed rack member 66L has holes 66La for fitting therein the pins 60Lc in order to secure the left manual feed rack member 66L and the left manual feed side regulating member 60L together. Similarly, the right manual feed rack member 66R has holes 66Ra for fitting therein the pins 60Rc in order to secure the right manual feed rack member 66R and the right manual feed side regulating member 60R together.

As a result, the left manual feed rack member 66L is supported so as to be slidable horizontally along with the left manual feed side regulating member 60L, whereas the right manual feed rack member 66R is supported so as to be slidable horizontally along with the right manual feed side regulating member 60R.

A synchronous gear 68 is rotatably supported by the pin 64 at the back side of the manual sheet feed tray 44. A rack section 66Lb of the left manual feed rack member 66L and a rack section 66Rb of the right manual feed rack member 66R engage the synchronous gear 68 from above and below, respectively. Therefore, the left manual feed side regulating member 60L and the right manual feed side regulating member 60R are capable of moving closer to and away from each other. Consequently, it is possible to regulate the side edges of the manual feed sheet P1 by moving the manual feed side regulating members 60L and 60R in accordance with the size of the manual feed sheet P1.

Limiting members 70L and 70R, mounted to the multi-sheet side regulating members 16L and 16R of the multi-sheet feed section AF, are inserted in the cutouts 62*a* and 62*b* of the manual sheet feed tray 44. They are disposed outwardly relative to the manual feed side regulating members 60L and 60R in the direction of the width of the sheet. The limiting members 70L and 70R prevent the multi-sheet side regulating members 16L and 16R from moving inwardly relative to the manual feed side regulating members 60L and 60R in the direction of the width of the sheet. The limiting members 70L and 70R are mounted outwardly relative to the side walls 16Lb and 16Rb of the multi-sheet side regulating members 16L and 16R, so as to regulate the manual feed side regulating members 60L and 60R by contacting the outer sides of the side walls 60Lb and 60Rb of the regulating members 60L and 60R, respectively. Therefore, while the limiting members 70L and 70R are regulating the regulating members 60L and 60R, the location of the side wall 16Lb of the multi-sheet side regulating member 16L matches the location of the side wall 60Lb of the manual feed side regulating member 60L in the direction of the width of the sheet, and the location of the side wall 16Rb of the multi-sheet side regulating member 16R matches the location of the side wall 60Rb of the manual feed side regulating member 60R in the direction of the width of the sheet.

As with the multi-sheet side regulating members 16L and 16R of the multi-sheet feed section AF, since the center of the conveyance path is used as the reference, in the present embodiment, the left and right manual feed side regulating members 60L and 60R of the manual sheet feed section MF are constructed so as to be movable horizontally for sheet feeding. However, only one of the regulating members 60L and 60R may be constructed as being movable when sheets are conveyed using one side of the conveyance path as the reference.

A description will now be given of the operation of the sheet feeder having the above-described construction.

When a sheet P is to be fed from the multi-sheet feed section AF, a sheet P is loaded on the multi-sheet feed tray 2, and the left and right multi-sheet side regulating members 16L and 16R are moved by sliding to match the side edges of the sheet P with the side walls 16Lb and 16Rb, whereby the sheet P is supported at the center of the conveyance path for feeding. Here, the manual feed side regulating members 60L and 60R of the manual sheet feed section MF are prevented from moving outwardly of the multi-sheet side regulating members 16L and 16R in the direction of the width by the limiting members 70L and 70R.

Rotation of the sheet feed roller 3 causes the sheets to be fed and separated one sheet at a time by the separation pad 22. The separated sheets are conveyed by the pair of conveyor rollers 4. Since the side walls 16Lb and 16Rb of the multi-sheet side regulating members 16L and 16R extend downstream from the pair of conveyor rollers 4, the sheets are regulated by the side walls 16Lb and 16Rb until they reach the vicinity of the transfer roller 5, and are conveyed to the image forming means without undergoing oblique movement and with the center of the sheet in the direction of the width thereof properly balanced and nipped by the sheet feed roller 3 and the pair of conveyor rollers 4. Thus, oblique movement of the sheet is prevented and the accuracy with which the image is formed on the proper location of the sheet is increased.

A description will now be given of a case where a sheet P1 is manually fed from the manual sheet feed tray 44, while sheets P are supported by the multi-sheet feed tray 2.

When the width of the manual feed sheet P1 is smaller than the width of the sheets P on the multi-sheet feed tray 2, the side walls 60Lb and 60Rb of the manual feed side regulating members 60L and 60R moved by sliding so as to match the side edges of the manual feed sheet P1.

Inserting the manual feed sheet P1 along the side walls 60Lb and 60Rb causes it to move along the top surface of the sheet P on the multi-sheet feed tray 2 to a press-contact portion between the sheet feed roller 3 and the separation pad. With the sheet P1 at the press-contact portion, rotation of the sheet feed roller 3 causes the manual feed sheet P1 to be fed and conveyed to the image forming means via the pair of conveyor rollers 4. Here, the distance between the side walls 16Lb and 16Rb of the multi-sheet side regulating members 16L and 16R is larger than the width of the manual feed sheet P1, thereby preventing the sheet P1 from striking the side walls 16Lb and 16Rb.

When the width of the manual feed sheet P1 is larger than the width of the sheets P on the multi-sheet feed tray 2, sliding the side walls 60Lb and 60Rb of the manual feed side regulating members 60L and 60R outwardly in the direction of the width in order to match the side walls 60Lb and 60Rb with the side edges of the manual feed sheet P1 causes the limiting members 70L and 70R to be pushed by the manual feed side regulating members 60L and 60R, as a result of which the multi-sheet side regulating members 16L and 16R are also pushed outward. Therefore, the separation distance between the side walls 16Lb and 16Rb of the multi-sheet side regulating members 16L and 16R does not get smaller than the separation distance between the side walls 60Lb and 60Rb of the manual feed side regulating members 60L and 60R.

The manual feed sheet P1 is sent to the image forming means by inserting the manual feed sheet P1 along the manual feed side regulating members 60L and 60R and rotating the sheet feed roller 3. Here, the separation distance between the side walls 16Lb and 16Rb of the multi-sheet side regulating members 16L and 16R of the multi-sheet feed section AF is equal to the width of the manual feed sheet P1, so that a large size sheet is conveyed to the image forming means without undergoing oblique movement, since the manual feed sheet P1 is guided as its sides are regulated just before it reaches the transfer roller 5.

Accordingly, when the manual feed sheet P1 is inserted along the manual feed side regulating members 60L and 60R, it is possible to prevent improper insertion caused by the manual feed sheet P1 striking the side walls 16Lb and 16Rb of the multi-sheet side regulating members 16L and 16R, both of which extend up to a location just preceding the transfer roller 5 of the image forming means, and reliably prevent poor image formation occurring when an inserted sheet is fed obliquely and the image is not formed on the proper location of the sheet.

Figure 9:
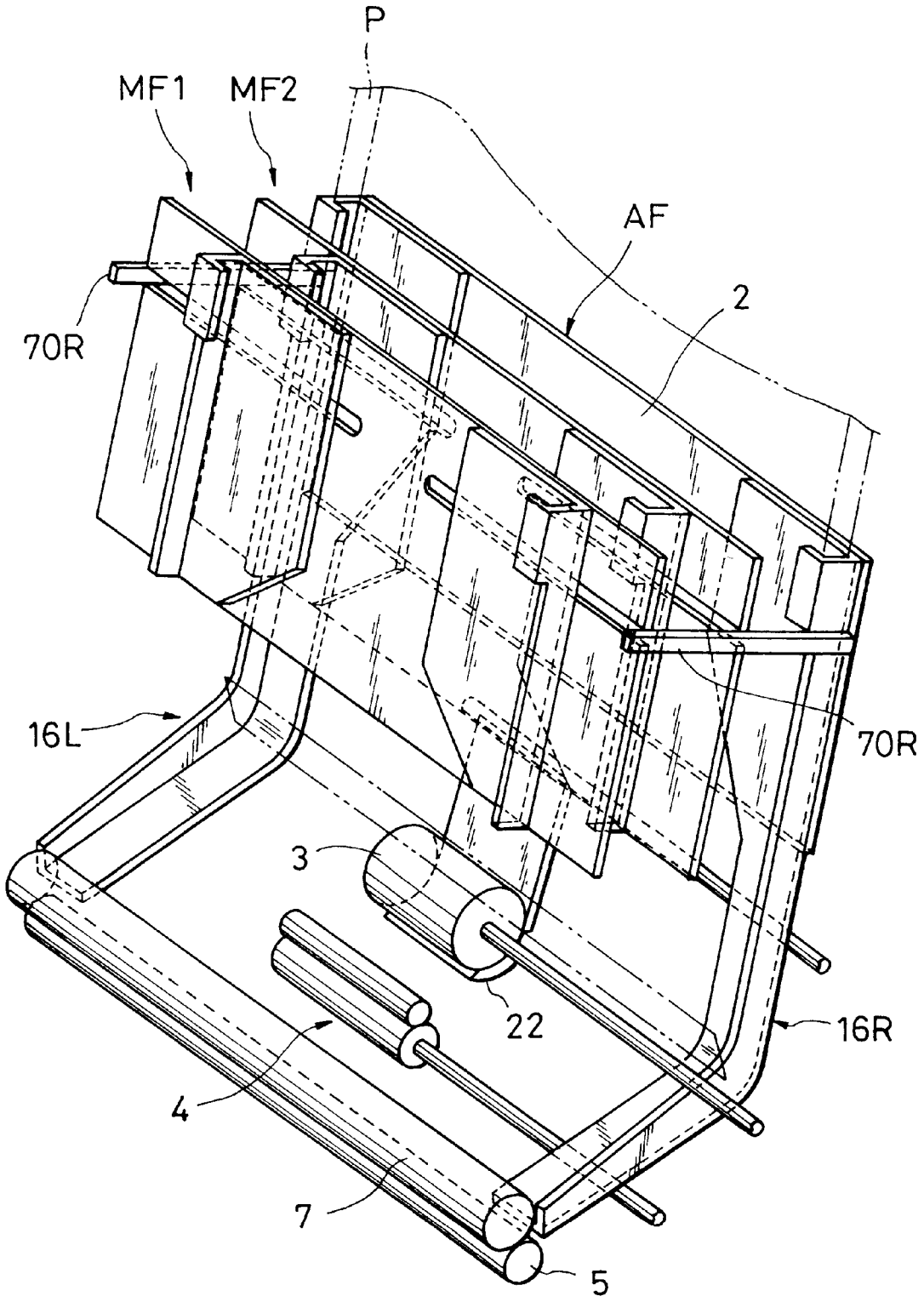
FIG. 9 is a perspective view showing a plurality of manual sheet feed sections disposed one above the other.

Although in the foregoing description, a single manual sheet feed section MF was used, a plurality of manual sheet feed sections MF may be used and placed one above the other. FIG. 9 illustrates a case where two such manual sheet feed sections MF are used. The manual sheet feed sections MF1 and MF2 have the same structure as the above-described manual sheet feed section MF. In this case, it is necessary to form the limiting members 70L and 70R, provided at the multi-sheet feed section AF, long enough to reach the side walls of the manual feed side regulating members of the topmost manual sheet feed section MF1. As with the above-described embodiment using only one manual sheet feed section MF, the manual sheet feed sections MF1 and MF2 permit an image to be properly formed on the manual feed sheet, or the like.

Figure 10:
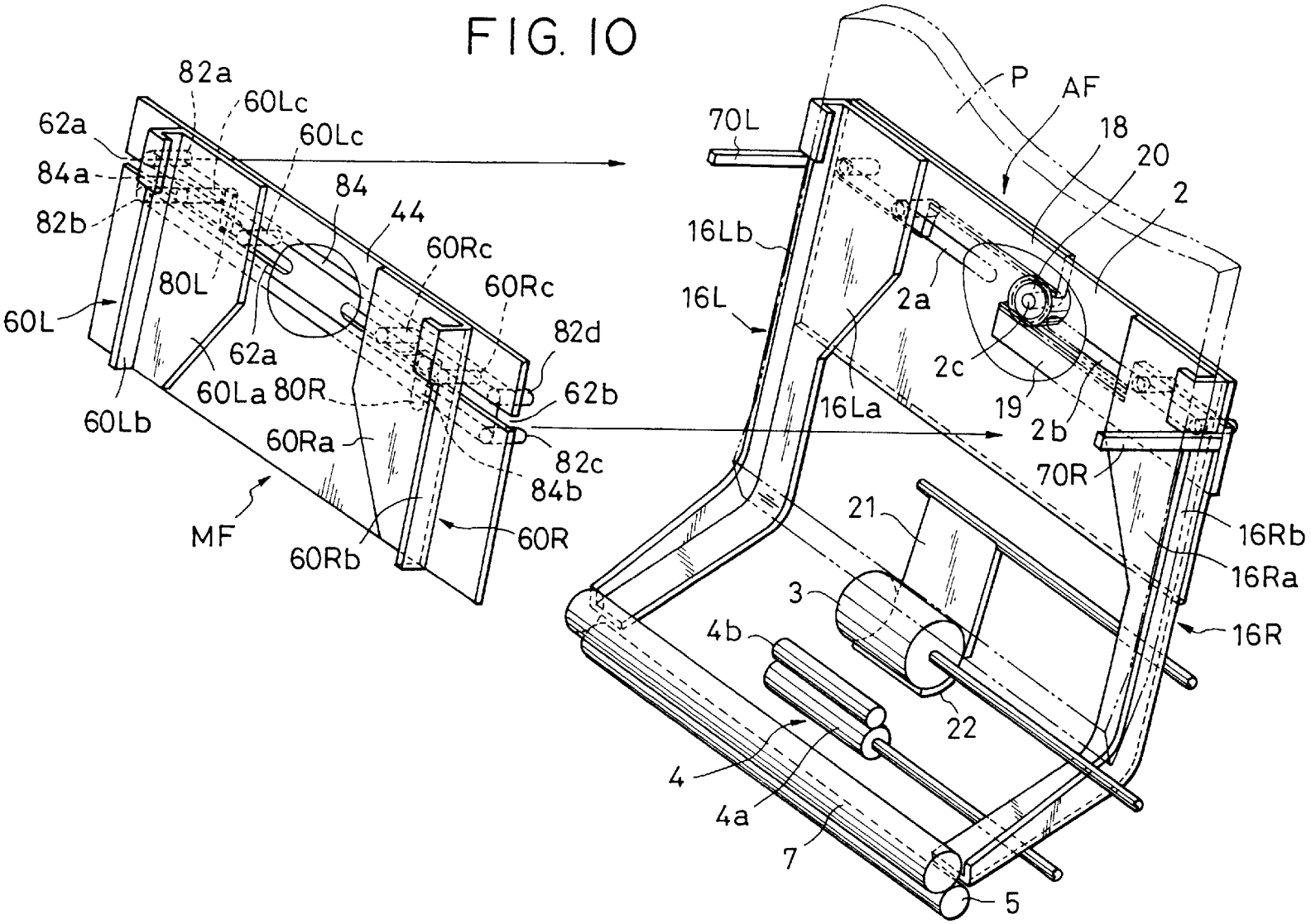
FIG. 10 is an exploded perspective view of means which allows movement of the left and right manual feed side regulating members of the manual sheet feed section in such a manner that when one regulating member moves, the other member also moves correspondingly.
Figure 11:
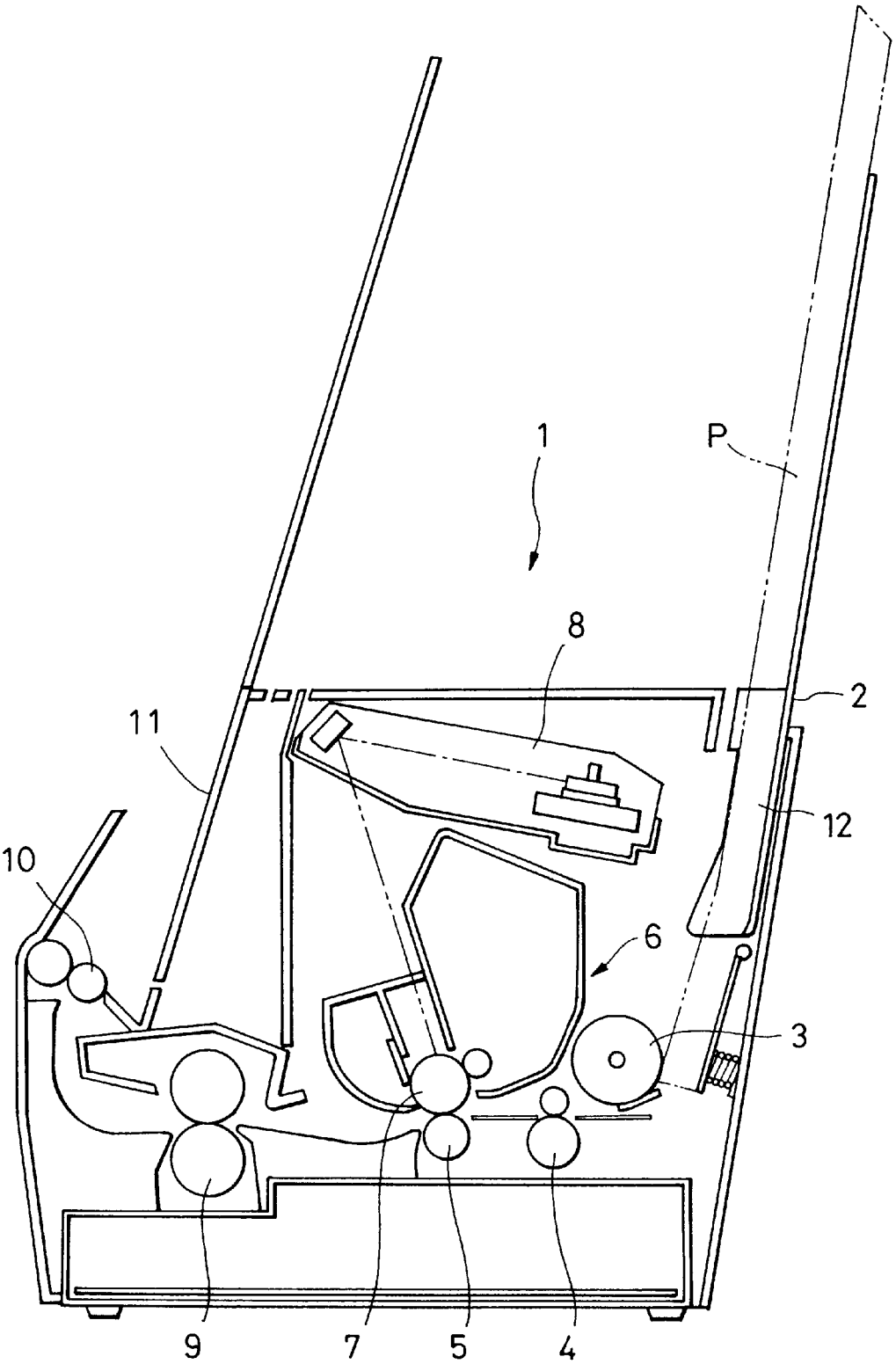
FIG. 11 PRIOR ART
FIG. 11 is a vertical section of an image forming apparatus provided with a conventional sheet feeder.

Although in the above-described embodiment, a rack and a synchronous gear 20 are used to allow movement of the left and right manual feed side regulating members in such a manner that when one member moves the other member moves correspondingly, a structure, shown in FIG. 10, may also be used to move the regulating members. In FIG. 10, corresponding components to those of FIG. 7 are given the same reference numerals and descriptions thereof will be omitted.

In this construction, linking members 80R and 80L protrude from the back side of the manual sheet feed tray 44 through the cutouts 62*a* and 62*b* from the manual feed side regulating members 60L and 60R. Pins 82*a*, 82*b*, 82*c*, and 82*d* protrude from the back side of the manual sheet feed tray 44, with a belt 84 placed around the pins such that the belt 84 can turn. Fitting the linking members 80L and 80R into holes 84*a* and 84*b* in the belt 84 allows sliding of the left and right manual feed side regulating members 60L and 60R in such a manner that when one member slides the other member slides correspondingly. Therefore, for example, when the right side regulating member 60R moves toward the center of the conveyance path, the belt 84 turns clockwise in FIG. 10, causing the left side regulating member 60L to also slide toward the center.

Accordingly, the structure using the belt 84 is a more simple structure than the rack and the synchronous gear structure, thus reducing costs of the manual sheet feed section MF. The manual sheet feed section MF may be constructed so as to be removably mountable to the multi-sheet feed section AF or the image forming apparatus body, thereby allowing the section MF to be mounted to the multi-sheet feed section AF or the image forming apparatus body as required.

What is claimed is:

1. A sheet feeder, comprising:

a sheet support which supports a plurality of sheets;

sheet feeding means for feeding sheets from said sheet support;

sheet conveying means for conveying the sheets fed by said sheet feeding means; and side regulating means for regulating both side edges of sheets supported by said sheet support in a direction of a width of the sheets, said side regulating means extending downstream from said sheet conveying means in a direction of sheet feeding so as to regulate both side edges of a sheet being conveyed by said sheet conveying means after the sheet passes said sheet feeding means.

2. A sheet feeder according to claim 1, further comprising transportation means, disposed downstream from said sheet feeding means in the direction of sheet feeding, for transporting the sheet fed from said sheet feeding means, wherein said side regulating means extends downstream from said transporting means.

3. A sheet feeder according to claim 1 or claim 2, wherein said side regulating means comprises a pair of left and right side regulating members, with at least one of said side regulating members being movable in the direction of the sheet width in accordance with a size of the sheets supported by said sheet support.

4. A sheet feeder according to claim 3, wherein said side regulating members each include a supporting section for supporting the bottom surface of a sheet at both side edges of the sheet and a regulating section for regulating the positions of both side edges of the sheet in the direction of the sheet width, said supporting section and said regulating section extending downstream from said sheet feeding means.

5. A sheet feeder according to claim 1 or claim 2, wherein said side regulating means includes a pair of left and right side regulating members, each of which is movable in the direction of the sheet width in accordance with the size of a sheet supported by said sheet support; and wherein said sheet feeder further comprises two means, separated by a predetermined distance in the direction of sheet feeding, for allowing movement of said side regulating members in such a manner that when one of said side regulating members moves, the other one of said side regulating members also moves correspondingly.

6. A sheet feeder according to claim 5, wherein said two means for allowing movement of said side regulating members each includes a rack member provided at said side regulating member and a synchronous gear with teeth for engaging the teeth of said rack member.

7. A sheet feeder according to claim 6, further comprising a gear or a belt for allowing rotation of said synchronous gear of said two means for allowing movement of said side regulating members with respect to each other.

8. A sheet feeder according to claim 1, wherein said sheet feeding means is a sheet feed roller disposed at the center of the sheets supported by said sheet support in the direction of the sheet width.

9. An image forming apparatus, comprising:

a sheet support which supports a plurality of sheets;

sheet feeding means for feeding sheets from said sheet support;

sheet conveying means for conveying the sheets fed by said sheet feeding means;

side regulating means for regulating both side edges of sheets supported by said sheet support in a direction of the sheet width, said side regulating means extending downstream from said sheet conveying means in a sheet feeding direction so as to regulate both side edges of a sheet being conveyed by said sheet conveying means after the sheet passes said sheet feeding means; and image forming means for forming an image on a sheet fed from said sheet feeding means.

10. An image forming apparatus according to claim 9, wherein said side regulating means extends to the vicinity of the upstream side of said image forming means in the sheet feeding direction.

11. A sheet feeder, comprising:

a sheet support which supports a plurality of sheets;

side regulating means for regulating both side edges of the sheets supported by said sheet support in a direction of a width of the sheets;

a manual feed sheet support which supports manual feed sheets;

a manual feed side regulating means for regulating both side edges of manual feed sheets supported by said manual feed sheet support in a direction of a width of the sheets;

sheet feeding means for feeding sheets supported on said sheet support and manual feed sheets from said sheet support or manual feed sheet support; and limiting means for limiting operation of said side regulating means and said manual feed side regulating means so that a regulated sheet distance of said manual feed side regulating means does not become larger than a regulated sheet distance of said side regulating means while the manual feed sheets are fed by said feeding means from said manual feed sheet support.

12. A sheet feeder according to claim 11, wherein said side regulating means comprises a pair of left and right side regulating members, with at least one of said side regulating members being movable in the direction of the sheet width in accordance with a size of the sheets supported by said sheet support, and said manual feed side regulating means comprises a pair of left and right manual feed side regulating members, with at least one of said manual feed side regulating members being movable in the direction of the manual feed sheet width in accordance with a size of the manual feed sheets supported by said manual feed support, and said limiting means limits the movement of said manual feed side regulating members.

13. A sheet feeder according to claim 12, wherein said sheet support supporting the plurality of sheets and said manual feed sheet support are placed on top of each other in a vertical direction, and wherein said limiting means is disposed so as to be contactable with said manual feed side regulating members from the outer side of said manual feed side regulating members in the direction of the sheet width.

14. A sheet feeder according to claim 13, wherein said manual feed side regulating members are disposed upstream from said sheet feeding means.

15. An image forming apparatus, comprising:

a sheet support which supports a plurality of sheets;

side regulating means for regulating both side edges of the sheets supported by said sheet support in a direction of a width of the sheets;

a manual feed sheet support which supports manual feed sheets;

a manual feed sheet regulating means for regulating both side edges of the manual feed sheets supported by said manual feed sheet support in a direction of a width of the manual feed sheets;

sheet feeding means for feeding sheets and manual feed sheets from said sheet support or manual feed sheet support;

limiting means for limiting operation of said side regulating means and said manual feed side regulating means so that a regulated sheet distance of said manual feed side regulating means does not become larger than a regulated sheet distance of said side regulating means while the manual feed sheets are fed by said feeding means from said manual feed sheet support; and image forming means for forming an image on a sheet fed from said sheet feeding means.

* * * * *

UNITED STATES PATENT AND TRADEMARK OFFICE

CERTIFICATE OF CORRECTION

PATENT NO. : 5,927,702

DATED : July 27, 1999

INVENTOR(S): HIROYUKI ISHII, ET AL.

It is certified that error appears in the above-identified patent and that said Letters Patent is hereby corrected as shown below:

COVER PAGE AT ITEM [56] U.S. PATENT DOCUMENTS, "2,195,464 3/1940 Loewenstein" should read --2,195,464 4/1940 Loewenstein--.

COVER PAGE AT ITEM [56] FOREIGN PATENT DOCUMENTS, "357199739" should read --57-199739--; "360061428" should read --60-61428--; "40507000" should read --5-7000--; and "405319583" should read --5-319583--.

Signed and Sealed this

Eighth Day of February, 2000

*Attest:*

*Attesting Officer*

Q. TODD DICKINSON

*Commissioner of Patents and Trademarks*